United States Patent [19]

Donomoto et al.

[11] 4,450,207

[45] May 22, 1984

[54] FIBER REINFORCED METAL TYPE COMPOSITE MATERIAL WITH HIGH PURITY ALUMINUM ALLOY CONTAINING MAGNESIUM AS MATRIX METAL

[75] Inventors: Tadashi Donomoto; Atsuo Tanaka; Yoshiaki Tatematsu; Tsugio Akai, all of Toyota, Japan

[73] Assignee: Toyota Jidosha Kabushiki Kaisha, Toyota, Japan

[21] Appl. No.: 525,899

[22] Filed: Aug. 24, 1983

[30] Foreign Application Priority Data

Sep. 14, 1982 [JP] Japan ..... 57-161397

[51] Int. Cl.[3] ..... B22D 19/14; B21D 37/00; C22C 21/06

[52] U.S. Cl. ..... 428/614; 428/608

[58] Field of Search ..... 428/614, 608

[56] References Cited

U.S. PATENT DOCUMENTS

| | | | |
|---|---|---|---|
| 3,469,952 | 9/1969 | Baker | 428/614 |
| 3,547,180 | 12/1970 | Cochran et al. | 428/614 |
| 3,691,623 | 9/1972 | Staudhammer et al. | 428/614 |
| 3,970,136 | 7/1976 | Cannell et al. | 428/614 |

*Primary Examiner*—Veronica O'Keefe

*Attorney, Agent, or Firm*—Oblon, Fisher, Spivak, McClelland & Maier

[57] ABSTRACT

A fiber reinforced metal type composite material is composed essentially of a mass of reinforcing fibers intimately compounded with a matrix metal. The reinforcing fibers are either alumina fibers, carbon fibers, or a mixture thereof. The matrix metal is an alloy consisting essentially of between about 0.5% and about 4.5% magnesium, less than about 0.2% each of copper and titanium, less than about 0.5% each of silicon, zinc, iron, and manganese, and the remainder aluminum. Preferably, the amount of magnesium is between about 0.7% and about 4.5%, and even more preferably it is between about 1.0% and about 4.0%.

6 Claims, 5 Drawing Figures

FIBER REINFORCED METAL TYPE COMPOSITE MATERIAL WITH HIGH PURITY ALUMINUM ALLOY CONTAINING MAGNESIUM AS MATRIX METAL

BACKGROUND OF THE INVENTION

The present invention relates to the field of fiber reinforced metal type composite materials, and more particularly relates to the field of such fiber reinforced metal type composite materials which include alumina or carbon fibers as reinforcing material, or mixtures thereof, and which utilize aluminum alloy as the matrix metal.

In motor vehicles and aircraft and so forth, nowadays, the constant demand for lightening and strengthening of structural members and parts has meant that construction from aluminum has become common. Problems arise, however, in making parts from aluminum or aluminum alloys, despite the light weight of these aluminum alloys, and despite their easy workability, because the mechanical characteristics of aluminum alloys such as strength, including bending resistance, torsion resistance, tensile strength, and so on are inferior to those of competing materials such as steel. Further, the occurrence of cracking and the spreading of cracks in parts made of aluminum alloy can be troublesome. Therefore, for parts the strength of which is critical there are limits to the application of aluminum alloys.

Accordingly, for such critical members, it has become known and practiced for them to be formed out of so called two phase or composite materials, in which reinforcing material is dispersed within a matrix of metal. If the matrix metal is aluminum alloy, then the advantages with regard to weight and workability of using this aluminum alloy as a constructional material can be obtained to a large degree, while avoiding many of the disadvantages with regard to low strength and crackability; in fact, the structural strength of the composite materials made in this way can be very good, and the presence of the reinforcing material can stop the propagation of cracks through the aluminum alloy matrix metal. The reinforcing material conventionally has been known as for example being alumina fibers, or carbon fibers, or a mixture thereof, and the matrix metal has been known as for example being various types of aluminum alloy; and various proposals have been made with regard to compositions for such fiber reinforced metal type composite materials, and with regard to methods of manufacture thereof. A brief discussion of these types of composite materials, and their methods of manufacture that have been developed by various companies, and of the related aluminum alloys that are used for the matrix metal thereof, will now be given.

1. THE HIGH PRESSURE CASTING METHOD

First a mass of reinforcing fibers is placed in the mold cavity of a casting mold, and then a quantity of molten aluminum alloy is poured into the mold cavity. The molten aluminum alloy matrix metal is then pressurized to a high pressure such as approximately 1000 kg/cm$^2$ by a plunger or the like, which may be slidingly fitted into the mold. Thereby the molten matrix metal is intimately infiltrated into the interstices of the mass of reinforcing fibers, under the influence of this pressure. This pressurized state is maintained until the aluminum alloy matrix metal has completely solidified. Then finally, after the aluminum alloy has solidified and cooled into a block, this block is removed from the casting mold, and the surplus aluminum alloy around the reinforcing fibers is removed by machining, so that the composite material mass itself, consisting of the mass of reinforcing fibers impregnated with aluminum alloy matrix metal, is isolated. This high pressure casting method has the advantage of low cost, and it is possible thereby to manufacture an element of a relatively complicated shape with high efficiency.

With regard to this high pressure casting method, as is described in Japanese patent application No. Sho 55-107040 (1980), the reinforcing material fiber mass may be preheated to a substantially high temperature of at least the melting point of the aluminum alloy matrix metal, before the matrix metal is poured into the casting mold, in order to aid with the proper penetration into and proper impregnation of the reinforcing material fibers by the matrix metal. Further, as is described in Japanese patent application No. Sho 56-32289 (1981), the reinforcing material fiber mass may be, before the casting process, charged into a case of which only one end is left open, an air chamber being left between the reinforcing material fiber mass and the closed end of the stainless steel case, and then the case with the reinforcing fiber mass therein may be placed into the mold cavity of the casting mold, and pressure casting as described above may be carried out. This concept of utilizing a case with an air chamber being left therein again serves to aid with the proper penetration into and proper impregnation of the reinforcing material fibers by the matrix metal, and more details will be found in the above identified Japanese patent application, if required.

In this high pressure casting method, a typical aluminum alloy used is JIS (Japanese Industrial Standard) type AC8A, which is approximately 12.0% silicon, 0.8% copper, 1.2% magnesium, 2.5% nickel, and the remainder aluminum. Another possibility is JIS AC8B, which is approximately 9.5% silicon, 3.0% copper, 1.0% magnesium, 1.0% nickel, and the remainder aluminum; and another is JIS AC4C, which is approximately 7.0% silicon, 0.3% magnesium, and the remainder aluminum. Various other possibilities are also employed.

2. THE METHOD OF THE COMPANY FIBER MATERIAL INC.

This method is performed as follows. First, onto the surfaces of carbon fibers titanium and/or boron is applied by chemical evaporation deposition, and then these fibers are dipped into molten aluminum alloy, thus forming a preimpregnated mass, since the fibers are thus precoated with aluminum alloy. Next, a number of layers of this preimpregnated mass are sandwiched together and sintered. The production cost of this preimpregnation method for producing a composite material is high, as compared with the cost of the above described high pressure casting method, and there are other defects inherent therein, such as the fact that the volume ratio of the reinforcing fibers cannot be made very high, and also that is it not possible to manufacture elements of complicated shapes such as for example cylinders.

In this dipping type preimpregnation method, a typical aluminum alloy used is AA standard A201, which is approximately 0.1% silicon, 4.7% copper, 0.3% magnesium, 0.6% silver, and the remainder aluminum. Another possibility is AA standard A356, which is approximately 7.0% silicon, 0.2% copper, 0.3% magnesium, and the remainder aluminum; and another is AA standard A6061, which is approximately 0.6% silicon, 0.25% copper, 1.0% magnesium, 0.2% chromium, and the remainder aluminum. Various other possibilities are also employed; these are all general purpose type aluminum alloys and rolling aluminum alloys.

3. THE METHOD OF THE COMPANY TOHO BESURON K.K.

This method is performed as follows. First, onto the surfaces of carbon fibers aluminum alloy is deposited by physical evaporation deposition, thus forming a preimpregnated mass, since the fibers are thus precoated with aluminum alloy. Next, a number of layers of this preimpregnated mass are sandwiched together and hot pressed together. The production cost of this preimpregnation method for producing a composite material is also high, as compared with the cost of the above described high pressure casting method, and there are again other defects inherent therein, such as the fact that the volume ratio of the reinforcing fibers cannot be made very high, and also that it is not possible to manufacture elements of complicated shapes such as for example cylinders.

In this evaporation type preimpregnation method, the aluminum alloy generally used is AA standard A5056, which is approximately 0.3% silicon, 0.1% copper, 4.5% to 5.6% magnesium, 0.4% iron, 0.05% to 0.2% manganese, 0.05% to 0.2% chromium, 0.1% zinc, and the remainder aluminum. This aluminum alloy is generally used because it has good wetting ability in conjunction with carbon fibers and is suitable for diffusion bonding.

4. THE METHOD OF THE DUPONT COMPANY

In this method, a mass of reinforcing material in the form of alumina fibers is fitted into a stainless steel case of tubular form which is open at both ends, and then one end of the case is dipped into molten aluminum alloy, while the pressure at the other end of the case is reduced by sucking, so that the aluminum alloy is sucked up and is caused to impregnate between the alumina fibers. In this method, reuse of the stainless steel case is difficut, which increases the cost of production, and also in order to have good wetting ability of the alumina fibers by the molten aluminum alloy matrix metal it is necessary to add a certain amount of lithium to the molten aluminum alloy. Since such lithium is expensive, this further undesirably increases the production cost, thus resulting in a high cost fiber reinforced metal composite material product.

In this sucking impregnation type of method for making composite material, the aluminum alloy generally used is an aluminum alloy containing about two to three percent lithium and the remainder aluminum; if the lithium content is greater than about three percent, then the alumina fibers deteriorate, whereas if the lithium content is less than about two percent the aluminum alloy does not well wet the alumina fibers and penetrate between them into their interstices to impregnate them. For these reasons, maintaining the lithium content of the aluminum alloy in this tight range is important, and this is difficult. This further increases the cost of the resulting composite material.

5. OTHER METHODS

Other methods such as powder metallurgy methods are known for making such a fiber reinforced metal composite material, and in these methods the aluminum alloy used is generally a general purpose rolling aluminum alloy, such as AA standard A6061 or AA standard A2024.

CONCLUSIONS REGARDING THESE METHODS

Now, as described above various methods of manufacture have been tried for such fiber reinforced metal type composite materials, but of these the most generally and usefully applicable has so far been the high pressure casting method, in view of the low cost of the fiber reinforced metal type composite material produced thereby, and the manufacturing efficiency attained thereby, as well as the ability to produce different shapes including quite complicated shapes. With regard to the types of reinforcing fibers so far used for manufacturing such fiber reinforced type composite materials, various such kinds of fibers have been tried including alumina fibers, carbon fibers, boron fibers, silicon carbide fibers, and the like, but of these it has so far been the case that alumina fibers are preferred when the fiber reinforced metal type composite material is required to have high strength and particularly good high temperature characteristics, while on the other hand carbon fibers are preferred when the fiber reinforced metal type composite material is required to have high strength and particularly good rigidity. With regard to the types of aluminum alloys so far used for use as matrix metal in such fiber reinforced type composite materials, the aluminum alloys so far used have generally been selected with no particular fixed criteria from conventional general purpose casting aluminum alloys and rolling aluminum alloys, as detailed at some length above. However, the fiber reinforced type composite materials that have so far been produced, although of high quality and performance in many characteristics, still leave room for improvement with regard to their mechanical properties such as strength and rigidity and the like, especially at high temperatures, and with regard to their durability.

SUMMARY OF THE INVENTION

Therefore, the inventors of the present application has performed various experimental researches, to be detailed later, regarding various possible compositions for the aluminum alloy matrix metal to be used in such a high pressure casting method for making such a fiber reinforced metal type composite material, in order to determine what composition for this aluminum alloy produces a resulting composite material with the most desirable physical characteristics such as bending strength, torsional strength, tensional strength, and so on. These experimental researches have concentrated on manufacturing such fiber reinforced metal type composite materials in which the fibers used as reinforcing material are carbon fibers, alumina fibers, or a mixture thereof, in view of the above mentioned determinations that these types of reinforcing fibers provide generally good characteristics for the resulting composite material, in combnation with aluminum alloy.

Accordingly, it is the primary object of the present invention to provide a fiber reinforced metal type composite material, the reinforcing material of which is carbon fibers or alumina fibers or a mixture thereof and the matrix metal of which is aluminum alloy, which has superior mechanical characteristics, such as bending strength, tensile strength, and fatigue strength.

It is a further object of the present invention to provide such a fiber reinforced metal type composite material, which is economical to manufacture.

According to the present invention, these and other objects are accomplished by a fiber reinforced metal type composite material, composed essentially of a mass of reinforcing fibers selected from the group consisting of alumina fibers, carbon fibers, and mixtures thereof, intimately compounded with a matrix metal which is an alloy consisting essentially of between about 0.5% and about 4.5% magnesium, less than about 0.2% each of copper and titanium, less than about 0.5% each of silicon, zinc, iron, and manganese, and remainder aluminum.

According to such a constitution, in summary, it has been determined by the present inventors, based upon the experimental researches which they have performed, that the aluminum alloy should have a certain definite proportion of magnesium contained in it, within an appropriate range as detailed above of between about 0.5% and about 4.5%, and that the amount of in particular included silicon and the copper, as well as the other listed impurities, should be kept below the specified threshold value. As will be seen from the description of these experimental researches which will be given later in this specification, this constitution of the aluminum alloy means that it has superior mechanical characteristics, such as in particular good bending strength, good fatigue strength, good resistance to rotary bending, and good tensile strength. These experiments show that if the amount of included silicon or copper in the aluminum alloy matrix metal rises above these specified amounts, then the undesirable results arise with regard to diminished bending strength, fatigue strength, and the like of the resulting composite material. The improvement in performance obtained by the present invention, by providing an aluminum alloy matrix metal as specified above, is accomplished without providing any particularly expensive constituents for the alloy, and accordingly means that its cost of production, and hence the cost of production of the composite material as a whole, is reasonable and not excessive. Accordingly this fiber reinforced metal type composite material, although being of reasonable price, is of a performance which is well suited to manufacture of important structural members in applications which demand high strength and lightness, such as in particular for making structural members for critical automotive and aviation applications.

Now, the following are considered by the present inventors to be the reasons why the composite material manufactured using the aluminum alloy of the type specified above has such good mechanical characteristics, such as bending strength, fatigue resistance, tensile strength, and so forth.

First, there are O and/or OH radicals attached to the surface of the reinforcing fibers such as the alumina fibers or carbon fibers, and since magnesium has a strong affinity for oxygen and has thus a strong tendency to form oxides, it reacts strongly with these O and OH radicals, so that the surface activity of the alumina and/or carbon fibers is reduced. Therefore the wettability by the molten aluminum alloy is increased. As a result, the contact between the alumina and/or carbon fiber reinforcing material and the aluminum alloy matrix metal of the composite material is improved.

Next, since the surface energy of the molten aluminum alloy is reduced by the addition of the magnesium contained therein, and since its flowability is improved, thereby the molten aluminum alloy penetrates better and more freely between the fibers of the reinforcing material, such as the alumina and/or carbon fibers.

Yet further, as compared with silicon or copper, little of the beta phase of the magnesium is separated out in the vicinity of the fibers of the reinforcing material, such as the alumina and/or carbon fibers, and therefore there is little concentration of stress around these alumina and/or carbon reinforcing fibers by the separating out of beta phase around them.

In addition to these reasons for the high strength of the composite material according to the present invention, as a reason for the superior fatigue strength of this composite material it is considered that the aluminum alloy used as matrix metal has good ductility. In other words, when the amount of magnesium additive is at its maximum, according to the present invention, of around 4.5%, then as compared with the case wherein similar amounts of copper or silicon are added the reduction in ductility is small, and therefore the difference in thermal expansion between the aluminum alloy matrix metal and the reinforcing alumina and/or carbon fibers is easily and effectively absorbed.

Another detailed advantage of the present invention is that by utilizing an aluminum alloy of the type specified above as the matrix metal, in addition to the above described superior wettability of the alumina and/or carbon reinforcing material fibers by this aluminum alloy matrix metal, also this aluminum alloy has a relatively low melting point, and also has superior flowability when in the molten state, so that the fiber reinforced composite material according to the present invention is very suitable for the manufacture of elements such as mechanical parts which are of relatively complicated shapes, by using the high pressure casting method. This allows for particularly efficient and low cost manufacture.

Further, according to a more particular aspect of the present invention, these and other objects are more particularly and concretely accomplished by a fiber reinforced metal type composite material of the type described above, wherein the amount of magnesium in said matrix metal alloy is between about 0.7% and about 4.5%.

According to such a constitution, the limits upon the content of magnesium in the aluminum alloy matrix metal are made more strict. As will be seen later from the description of the experiments made by the present inventors, the qualities of the resulting composite material made by observing this further limitation with regard to the amount of magnesium contained in the aluminum alloy matrix metal are further improved, as compared with the basic composition according to the present invention specified above.

Further, according to another more particular aspect of the present invention, these and other objects are more particularly and concretely accomplished by a fiber reinforced metal type composite material of the type proximately described above, wherein the amount of magnesium in said matrix metal alloy is between about 1.0% and about 4.0%.

According to such a constitution, the limits upon the content of magnesium in the aluminum alloy matrix metal are made still more strict. As will be seen later from the description of the abovementioned experiments, the qualities of the resulting composite material made by observing this yet further limitation with regard to the amount of magnesium contained in the aluminum alloy matrix metal are even better, than in the case of the basic composition according to the present invention specified above.

As an additional concept which is very helpful in the context of the present invention, the aluminum alloy matrix metal used in the composite material of the present invention may contain a small quantity, such as about 0.004%, of beryllium. This is very helpful for reducing the oxidization ablation of the magnesium, which is the important additive element in the aluminum alloy matrix metal.

It should be noted that unless otherwise specified all the percentages given in this specification are percentages by weight, and all expressions including ranges of values are to be interpreted as inclusive ranges.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
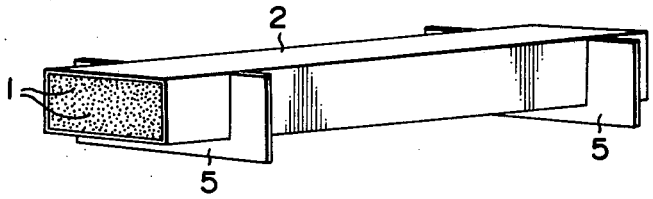
FIG. 1 is a perspective view of a stainless steel case which has been charged with a mass of reinforcing fibers, in preparation for impregnation of these reinforcing fibers with matrix metal so as to make a composite material, as in the manufacture of various embodiments of the material according to the present invention.

The present invention will now be described with reference to a number of preferred embodiments thereof, and with reference to the appended drawings. The various embodiments will be introduced in the context of two sets of experiments relating to making various fiber reinforced metal type composite materials whose matrix metal is various aluminum alloys and testing them that have been performed by and under the aegis of the present inventors with a view to ascertaining the effect upon the qualities of these composite materials of varying different parameters of the materials of which they are made.

FIRST SET OF EXPERIMENTS: VARYING THE COMPOSITION OF THE ALUMINUM ALLOY USED WITH ALUMINA FIBERS

First, in order to evaluate for such fiber reinforced metal type composite materials the effect of varying the metallic composition of the aluminum alloy which is the matrix metal, in the case that the reinforcing material is alumina fibers, sixteen different test samples of composite material were made by the high pressure casting method. All of these sixteen test samples utilized the same type of alumina fibers as the reinforcing material: FP type alumina fibers manufactured by Dupont, of average fiber diameter 20 microns. But each of the sixteen test samples used a different type of aluminum alloy as the matrix metal, as shown in detail in Table 1, which is to be found at the end of this specification and before the claims thereof. Then evaluations were carried out of the bending strength and the fatigue strength of the various samples, which are denoted in Table 1 by reference numerals 1 through 16.

With regard to the aluminum alloys used as the maxtrix metal in these test samples 1 through 16, as can be seen from Table 1 they can be considered as defining four groups: test sample 1 is substantially pure aluminum with low percentages of other non aluminum components; test samples 2 through 7 define a group of aluminum-magnesium alloys, the percentage of magnesium increasing along with the test sample number, and with low percentages of other non aluminum components; test samples 8 through 12 similarly define a group of aluminum-silicon alloys, with percentages of silicon increasing along with the test sample number and with low percentages of other non aluminum components; and test samples 13 through 16 similarly define a group of aluminum-copper alloys, with percentages of copper increasing along with the test sample number and with low percentages of other non aluminum components.

Figure 2:
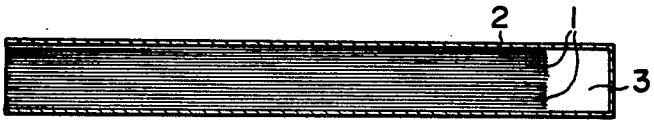
FIG. 2 is a longitudinal sectional view of the stainless steel case and the reinforcing fiber mass shown in FIG. 1, particularly showing an air chamber defined between a closed end of the case and the reinforcing fiber mass.

In detail, each of these sixteen test samples was made as follows: first a mass 1 of alumina fibers of the type specified above was formed so as to be aligned substantially all in one direction and so as to have a volume ratio of about 55% and a length of 100 mm. Next, this mass of alumina fibers 1 was inserted into a case 2 made of stainless steel of JIS standard SUS-304 which was of cuboidal form with one end open, having a length of 130 mm, a height of 16 mm, and a width of 36 mm, and was so positioned in this case 2 as to leave an air chamber 3 of approximately 30 mm in length at the closed end thereof; thus, one end of the alumina fiber mass 1 lay substantially flush with the open end of the case 2, as shown in FIGS. 1 and 2. FIG. 1 shows a perspective view of the case 2 with the alumina fiber mass 1 charged therein, together with a pair of supports 5, and FIG. 2 is a longitudinal sectional view thereof.

Next, the stainless steel case 2 with the alumina fiber mass 1 charged therein was preheated to a temperature of approximately 800° C. and was placed in the mold cavity of a casting mold 4, resting therein upon the supports 5 so as not directly to touch the wall of the mold cavity, the mold 4 being preheated to approximately 250° C. Then immediately a quantity 6 of molten aluminum alloy of the type shown in Table 1 with respect to the respective test sample, at a temperature of about 140° C. greater than its respective melting point, was poured into the mold cavity of the mold 4. The molten aluminum alloy matrix metal was then pressurized to a pressure of approximately 1000 kg/cm$^2$ by a plunger 7, which was slidingly fitted into the mold 4, and which was preheated to approximately 200° C. This pressurized state was maintained until the aluminum alloy matrix metal had completely solidified, Finally, after the aluminum alloy had solidified and cooled into a block, this block was removed from the casting mold 4, and the surplus aluminum alloy around the stainless steel case 2 was removed by machining. Then the case 2 was itself removed, and the composite material test sample itself, consisting of the mass 1 of reinforcing alumina fibers impregnated with aluminum alloy matrix metal, was isolated. In the high pressure casting process described above, the air chamber 3 was left between the reinforcing alumina fiber mass 1 and the closed end of the stainless steel case 2 before the pressure casting operation, as described in more detail in the previously identified Japanese patent application No. Sho. 56–32289 (1981), in order to aid with the proper penetration into and proper impregnation of the reinforcing material fibers by the matrix metal. Further, as also is described in more detail in the also previously identified Japanese patent application No. Sho 55-107040 (1980), the stainless steel case 2 with the alumina fiber mass 1 charged therein was preheated to a substantially high temperature of at least the melting point of the aluminum alloy matrix metal, i.e. in this case a temperature of approximately 800° C., again in order to aid with the proper penetration into and proper impregnation of the reinforcing material fibers by the matrix metal.

From each of these sixteen test samples 1 through 16, a first bending test sample was cut, having a length in the direction of orientation of the alumina fibers of 100 mm, a height of 2 mm, and a width of 10 mm, and for each of these first bending test samples a three point bending test was carried out for the fiber orientation 0° direction, with the distance between the supports being 40 mm. Further, from each of these sixteen test samples 1 through 16, a second bending test sample was cut, having a length in the direction perpendicular to the direction of orientation of the alumina fibers of 36 mm, a height of 2 mm, and a width of 10 mm, and for each of these second bending test samples a three point bending test was carried out for the fiber orientation 90° direction, with the distance between the supports being 15 mm. In each of these bending tests, the surface stress M/Z (where M is the bending moment at the instant of fracture, Z is the cross sectional coefficient of the bending test sample) was measured, and was taken as the bending strength of the bending test sample.

Figure 4:
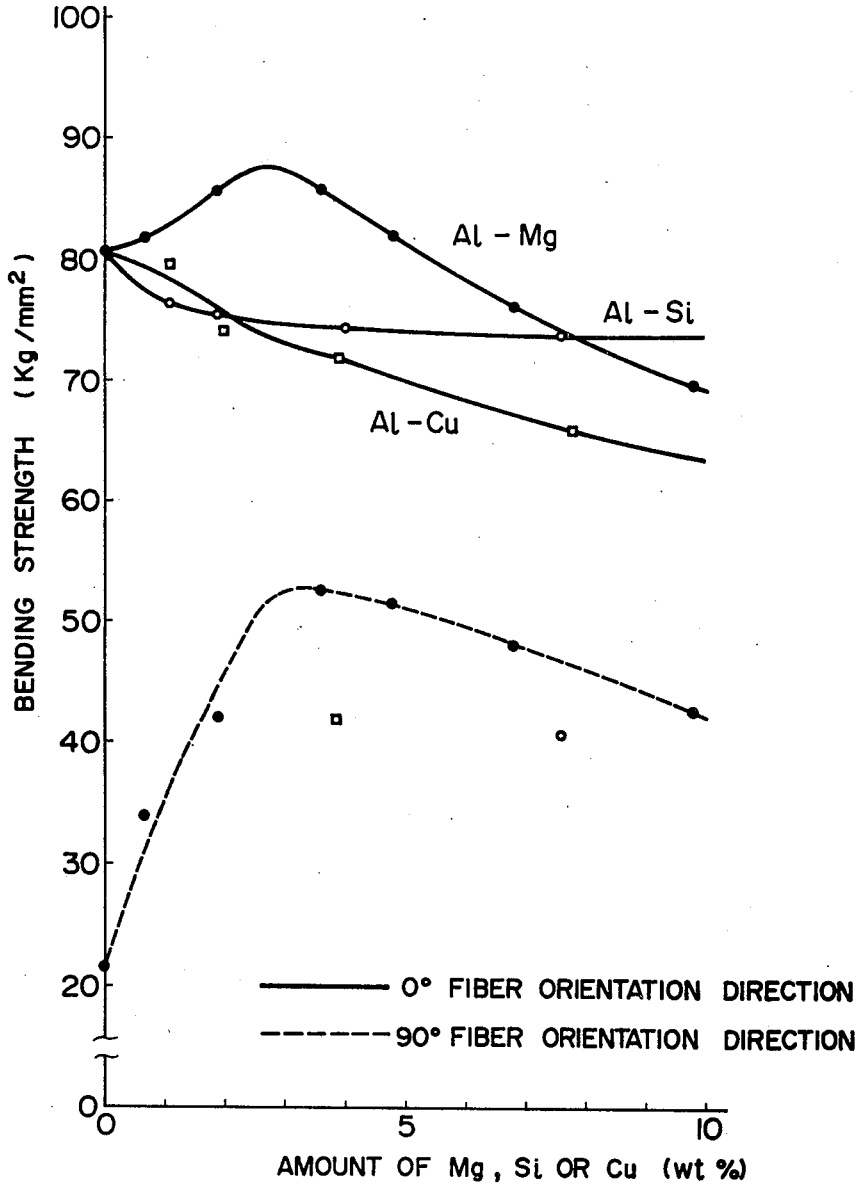
FIG. 4 is a set of graphs, relating to a first set of experiments, in which bending strength in the 0° fiber orientation direction and the 90° fiber orientation direction of sixteen different test samples in $kg/mm^2$ is shown along the vertical axis and percentage of the main non aluminum component of the matrix metal of each of the test samples are shown along the horizontal axis, and also in which approximate lines are drawn through the graph points relating to each type of bending strength test of each group of test samples which utilizes the same main non aluminum alloy component.

The results of these bending strength tests are given in Table 2, which is to be found at the end of this specification and before the claims thereof, and are partly summarized in FIG. 4 of the drawings, which is a graph showing bending strength of the various test samples along the vertical axis and percentage of the main non aluminum component of the matrix metal of the test sample along the horizontal axis, in which rough lines are drawn through the graph points relating to each group of test samples which utilizes one main non aluminum alloy component. The test sample number (1 through 16) in Table 2 corresponds to the material test sample number (1 through 16) in Table 1. In fact, several samples of each type of test sample were made, and results were obtained as given in Table 2 from several repetitions of the test for each type of sample, between four and six times each. The columns in Table 2 headed "average" show the average value obtained, for each of these types of test sample, of the results of said several repetitions of the bending tests.

Next, from each of the sixteen test samples 1 through 16, a rotary bending test sample was cut, having a length in the direction of orientation of the alumina fibers of 100 mm, a parallel portion length of 25 mm, a chuck portion diameter of 12 mm, and a parallel portion diameter of 8 mm, and each of these rotary test samples was mounted in a Krause type rotary bending fatigue test machine, and a fatigue test was carried out by rotating the test sample with a constant bending load, applying so called rotary bending, and the fatigue strength in kg/mm$^2$ under which $10^7$ repeated loads were withstood was measured. The results of these rotary bending fatigue tests are also given in Table 2.

CONCLUSIONS FROM THE FIRST SET OF EXPERIMENTS

The following conclusions are drawn by the present inventors from the results given in Table 2 and summarized in FIG. 4.

First, with regard to the bending strength in the fiber orientation 0° direction, considering the test samples utilizing as matrix metal aluminum alloys using various amounts of copper as additive and substantially no other significant quantities of non aluminum metals contained therein, i.e. the third group of test samples defined by samples 13 through 16, as shown in Table 2 and by the solid line entitled "Al-Cu" in FIG. 4, it will be understood that the bending strength in the fiber orientation 0° direction decreases approximately linearly with an increase in the amount of included copper. Accordingly, at least as far as this bending strength in the fiber orientation 0° direction is concerned, it is apparent that the optimum amount of copper to be included in the aluminum alloy matrix metal of the composite material is substantially no copper. Further, considering the test samples utilizing as matrix metal aluminum alloys using varying amounts of silicon as additive and substantially no other significant quantities of non aluminum metals contained therein, i.e. the second group of test samples defined by samples 8 through 12, as shown in Table 2 and by the solid line entitled "Al-Si" in FIG. 4, it will be understood that the bending strength in the fiber orientation 0° direction at first, up to a silicon content of approximately 2%, decreases relatively rapidly and approximately linearly with an increase in the amount of included silicon, and thereafter is substantially constant. Accordingly, at least as far as this bending strength in the fiber orientation 0° direction is concerned, it is apparent that the optimum amount of silicon to be included in the aluminum alloy matrix metal of the composite material is substantially no silicon. On the other hand, considering the test samples utilizing as matrix metal aluminum alloys using varying amounts of magnesium as additive and substantially no other significant quantities of non aluminum metals contained therein, i.e. the first group of test samples defined by samples 2 through 7, as shown in Table 2 and by the solid line entitled "Al-Mg" in FIG. 4, it will be understood that the bending strength in the fiber orientation 0° direction at first, up to a magnesium content of approximately 2.5%, increases relatively rapidly and approximately linearly with an increase in the amount of included magnesium, and thereafter decreases relatively slowly and approximately linearly with a further increase in the amount of included magnesium, to reach, when the amount of included magnesium content reaches about 5% or so, the same value as when substantially no magnesium is present, i.e. in the case of substantially pure aluminum matrix metal. Accordingly, at least as far as this bending strength in the fiber orientation 0° direction is concerned, it is apparent that the optimum amount of magnesium to be included in the aluminum alloy matrix metal of the composite material is about 2.5% or so, and in any case not more than about 5%.

Next, with regard to the bending strength in the fiber orientation 90° direction, in this case only the case of the test samples utilizing as matrix metal aluminum alloys using varying amounts of magnesium as additive and substantially no other significant quantities of non aluminum metals contained therein, i.e. the first group of test samples defined by samples 2 through 7, will be considered, since already these have been determined to be the most promising for investigation according to the results of the above described bending strength in the fiber orientation 0° direction tests. As also shown in Table 2 and by the dashed line in FIG. 4, it will be understood that the bending strength in the fiber orientation 90° direction at first, up to a magnesium content of approximately 3%, increases relatively rapidly and approximately linearly with an increase in the amount of included magnesium in the aluminum alloy matrix metal, and thereafter decreases relatively slowly and approximately linearly with a further increase in the amount of included magnesium. Accordingly, at least as far as this bending strength in the fiber orientation 90° direction is concerned, it is apparent that the optimum amount of magnesium to be included in the aluminum alloy matrix metal is about 3% or so.

Finally, with regard to the rotary bending fatigue tests, in the case of the test samples utilizing as matrix metal aluminum alloys using varying amounts of magnesium as additive and substantially no other significant quantities of non aluminum metals contained therein, i.e. the first group of test samples defined by samples 2 through 7, these tests were only carried out upon test sample 1 (matrix metal containing substantially no included magnesium) as a base for comparison and test sample 4 (matrix metal containing about 3.6% magnesium) as a representative, since it already had been determined from the tests regarding bending strength described above that this test sample 4 was the one which was the most promising for investigation. In fact, the rotary bending fatigue test result for sample 4 was substantially better, 47.0 kg/mm$^2$, than the rotary bending fatigue test result for sample 1, 39.5 kg/mm$^2$. Therefore the addition to the aluminum alloy matrix metal of magnesium to the tune of about 3.5% or so appeared to significantly improve the rotary bending strength of the composite material. On the other hand, in the cases of the test samples utilizing as matrix metal aluminum alloys using respectively varying amounts of silicon and copper as additive and substantially no other significant quantities of non aluminum metals contained therein, i.e. respectively the second and third groups of test samples respectively defined by test samples 8 through 12 and test samples 13 through 16, again these rotary bending fatigue tests were only carried out upon test sample 11 (matrix metal containing about 7.6% silicon) and test sample 15 (matrix metal containing about 3.9% copper) as representatives, since it already had been determined from the tests regarding bending strength described above that magnesium was the most promising additive for the aluminum alloy, and it was surmised that the use of matrix metal composed by the addition of silicon or copper to pure aluminum would actually deteriorate the result of the rotary bending fatigue test of the composite material made therefrom. In fact, this was found to be the case: the rotary bending strength of the test sample 11 was found to be only 36.5 kg/mm$^2$, as compared with the result of 39.5 kg/mm$^2$ for the case of the composite material sample 1 utilizing pure aluminum as the matrix metal, and the rotary bending strength of the test sample 15 was found to be only 35.0 kg/mm$^2$. Therefore the addition to the aluminum alloy matrix metal of either copper or silicon in a few percent appeared to significantly deteriorate the rotary bending strength of the composite material. Therefore, as a summary of the results of these rotary bending strength fatigue tests, it is considered that whereas the addition of a few percent of magnesium to pure aluminum for forming an aluminum alloy for use as matrix metal with alumina fibers as the reinforcing material was quite beneficial to the rotary bending strength, on the other hand it was undesirable to add any copper or silicon at all to the aluminum alloy matrix metal.

As a summary of the conclusions drawn from the bending strength tests as well as the rotary bending strength fatigue tests, it is considered that, in the case of elements fabricated from composite material utilizing as reinforcing material alumina fibers which are oriented along the longer direction of the elements and utilizing aluminum alloy as matrix metal, it is preferable for the amount of magnesium included as an additive to the pure aluminum for forming the aluminum alloy to be at least 0.5% and less than 4.5%, preferably at least 0.7% and less than 4.5%, and more preferably at least 1.0% and less than 4.0%. Further, it is considered that the amount of included copper and silicon in the aluminum alloy matrix metal should be limited as far as possible, and should in any case be less than 0.2% and 0.5% respectively.

Finally, although it is not particularly so described in any table or figure of this specification, tests were also carried out with regard to tensile strength of such a composite material including alumina reinforcing fibers, the matrix metal of which was aluminum alloy with a certain amount of magnesium included therein. The conclusion was reached that, in the case that the percentage of included magnesium was between 0.7% and 4.5%, the tensile strength in the fiber orientation 0° direction was between 60 and 65 kg/mm$^2$. This compares favorably with the tensile strength in the fiber orientation 0° direction of a composite material including alumina reinforcing fibers, the matrix metal of which is aluminum alloy of JIS standard AC8A containing about 2.5% of magnesium together with 12.0% of silicon and 0.8% of copper, which is between 56 and 59 kg/mm$^2$. Therefore it is considered that, in the case of elements fabricated from composite material utilizing as reinforcing material alumina fibers and utilizing aluminum alloy as matrix metal, also from the point of view of tensile strength it is preferable for the amount of magnesium included in the aluminum alloy to be substantial, with limited amounts of silicon and copper.

SECOND SET OF EXPERIMENTS: VARYING THE COMPOSITION OF THE ALUMINUM ALLOY USED WITH CARBON FIBERS

Figure 3:
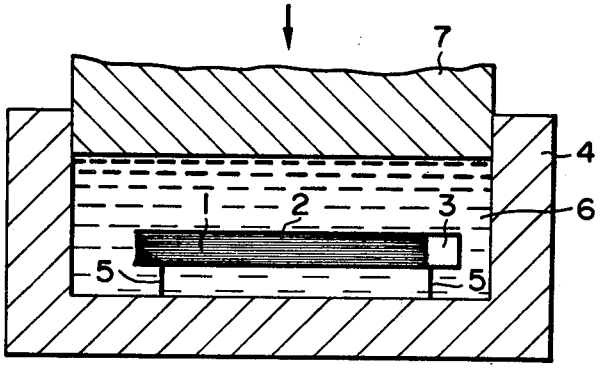
FIG. 3 is a schematic sectional view showing an apparatus performing the process of impregnating the reinforcing fiber mass charged into the stainless steel case as shown in FIGS. 1 and 2 with molten matrix metal, as in the manufacture of various embodiments of the material according to the present invention.

Next, in order to evaluate for such fiber reinforced metal type composite materials the effect of varying the metallic composition of the aluminum alloy which is the matrix metal, in the alternative case that the reinforcing material is carbon fibers, another sixteen different test samples of composite material were made by substantially the same type of high pressure casting method as in the first set of experiments described above, using substantially the same apparatus as shown in FIGS. 1 to 3, and utilizing as matrix metals the same respective sixteen aluminum alloys whose composition is described in Table 1, except for the difference that as reinforcing material instead was used carbon fibers, which were, for all of these sixteen test samples, the same type of carbon fibers: TOREKA type M 40 carbon fibers manufactured by Tore K.K., of average fiber diameter 7 microns and average fiber length of 100 mm. Then evaluations were carried out of the bending strength at 0° fiber orientation of the various test samples, which are again denoted by reference numerals 1 through 16. No particular fatigue tests were carried out, in this second set of experiments.

Figure 5:
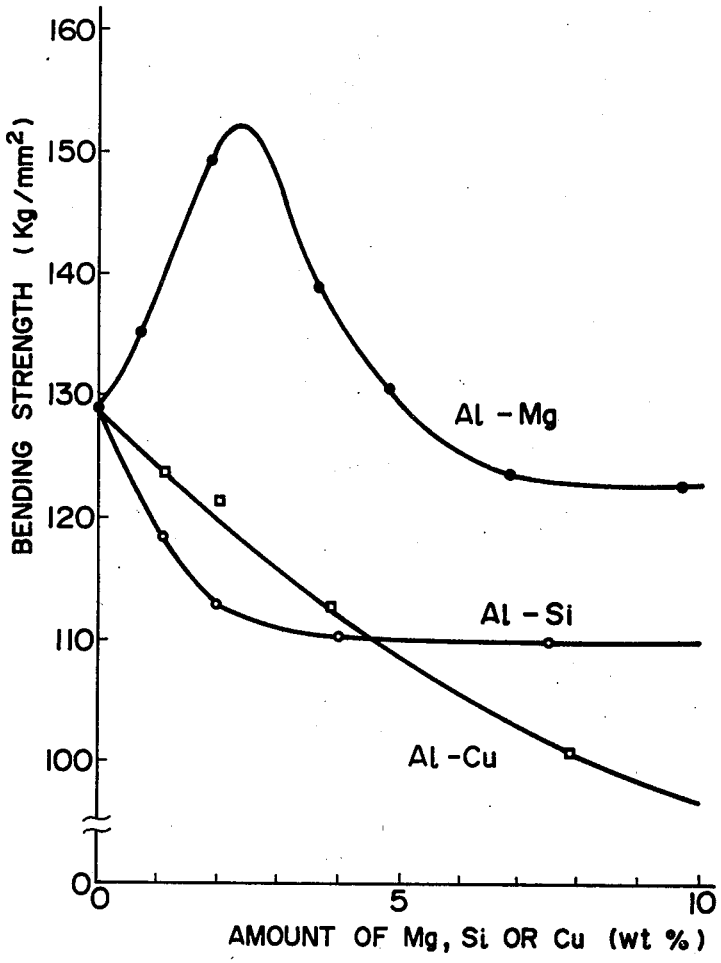
FIG. 5 is another set of graphs, similar to FIG. 4 but relating to a second set of experiments, in which again bending strength of sixteen different test samples in $kg/mm^2$ in the 0° fiber orientation direction only is shown along the vertical axis and percentage of the main non aluminum component of the matrix metal of each of the test samples is shown along the horizontal axis, and in which again approximate lines are drawn through the graph points relating to each group of test samples which utilizes the same main non aluminum alloy component.

The results of these bending strength tests are given in Table 3, which is to be found at the end of this specification and before the claims thereof, and are partly summarized in FIG. 5 of the drawings, which is a graph similar to FIG. 4 showing, for this second set of experiments, bending strength of the various test samples along the vertical axis and percentage of the main non aluminum component of the matrix metal of the test sample along the horizontal axis, in which again rough lines are drawn through the graph points relating to each of the three groups of test samples which utilizes one main non aluminum alloy component. The test sample number (1 through 16) in Table 3 again corresponds to the material test sample number (1 through 16) in Table 1. In fact, again several samples of each type of test sample were made, and results were obtained as given in Table 3 from several repetitions of the bending test for each type of sample, either four or five times each. The columns in Table 3 headed "average" show the average value obtained, for each of these types of test sample, of the results of said several repetitions of the bending tests.

CONCLUSIONS FROM THE SECOND SET OF EXPERIMENTS

The following conclusions are drawn by the present inventors from the bending strength in the fiber orientation 0° direction test results given in Table 3 and summarized in FIG. 5.

First, considering the test samples utilizing as reinforcing material the above described carbon fibers and as matrix metal aluminum alloys using varying amounts of copper as additive and substantially no other significant quantities of non aluminum metals contained therein, i.e. the third group of test samples defined by samples 13 through 16, as shown in Table 3 and by the solid line entitled "Al-Cu" in FIG. 5, it will be understood that the bending strength in the fiber orientation 0° direction again decreases approximately linearly with an increase in the amount of included copper. Accordingly, at least as far as this bending strength in the fiber orientation 0° direction is concerned, it is apparent that the optimum amount of copper to be included in the aluminum alloy matrix metal of the composite material is substantially no copper. Further, considering the test samples utilizing as matrix metal aluminum alloys using varying amounts of silicon as additive and substantially no other significant quantities of non aluminum metals contained therein, i.e. the second group of test samples defined by samples 8 through 12, as shown in Table 3 and by the solid line entitled "Al-Si" in FIG. 5, it will be understood that the bending strength in the fiber orientation 0° direction at first, up to a silicon content of approximately 4%, decreases relatively rapidly and approximately linearly with an increase in the amount of included silicon, and thereafter is substantially constant. Accordingly, at least as far as this bending strength in the fiber orientation 0° direction is concerned, it is apparent that the optimum amount of silicon to be included in the aluminum alloy matrix metal of the composite material is substantially no silicon. On the other hand, considering the test samples utilizing as matrix metal aluminum alloys using varying amounts of magnesium as additive and substantially no other significant quantities of non aluminum metals contained therein, i.e. the first group of test samples defined by samples 2 through 7, as shown in Table 3 and by the solid line entitled "Al-Mg" in FIG. 5, it will be understood that the bending strength in the fiber orientation 0° direction at first, up to a magnesium content of approximately 2.3%, increases relatively rapidly and approximately linearly with an increase in the amount of included magnesium, and thereafter decreases relatively slowly and approximately linearly with a further increase in the amount of included magnesium, to reach, when the amount of included magnesium content reaches about 5% or so, the same value as when substantially no magnesium is present, i.e. in the case of substantially pure aluminum matrix metal. Accordingly, at least as far as this bending strength in the fiber orientation 0° direction is concerned, it is apparent that the optimum amount of magnesium to be included in the aluminum alloy matrix metal of the composite material is about 2.3% or so, and in any case not more than about 5%.

No tests were performed with regard to the bending strength in the fiber orientation 90° direction, in this case of using carbon fibers as the reinforcing material. Nor were rotary bending fatigue tests carried out.

As a summary of the conclusions drawn from these bending strength tests, it is considered that, in the case of elements fabricated from composite material utilizing as reinforcing material carbon fibers and utilizing aluminum alloy as matrix metal, it is preferable for the amount of magnesium included as an additive to pure aluminum for forming an aluminum alloy for use as matrix metal with carbon fibers as the reinforcing material to be at least 0.5% and less than 4.5%, preferably at least 0.7% and less than 4.5%, and more preferably at least 1.0% and less than 4.0%. Further, it is considered that the amount of included copper and silicon in the aluminum alloy matrix metal should be limited as far as possible, and should in any case be less than 0.2% and 0.5% respectively.

Finally, although it is not particularly so described in any table or figure of this specification, tests were also carried out with regard to tensile strength of such a composite material including carbon reinforcing fibers, the matrix metal of which was aluminum alloy with a certain amount of magnesium included therein. The conclusion was reached that, in the case that the percentage of included magnesium was between 0.7% and 4.5%, the tensile strength in the fiber orientation 0° direction was between 90 and 105 kg/mm$^2$. This compares favorably with the tensile strength in the fiber orientation 0° direction of a composite material including carbon reinforcing fibers, the matrix metal of which is aluminum alloy of JIS standard AC8A containing about 2.5% of magnesium together with 12.0% silicon and 0.8% copper, which is between 68 and 72 kg/mm$^2$. Therefore it is considered that, in the case of elements fabricated from composite material utilizing as reinforcing material carbon fibers and utilizing aluminum alloy as matrix metal, also from the point of view of tensile strength it is preferable for the amount of magnesium included in the aluminum alloy to be substantial, with a limited amount of silicon and copper.

FURTHER TESTS

Also, although the test results relating thereto are not given in this specification in the interests of brevity and conciseness, a third set of experiments was carried out in the same way as the above two sets of experiments, in which composite materials were manufactured using an approximately 50—50 volume ratio of alumina fibers and carbon fibers, both of the above described sorts, and using various different aluminum alloys as the matrix metal. It was confirmed that, in the case of this type of composite material also, from the point of view of providing desirable properties thereof, it was preferable for the amount of magnesium included as an additive to pure aluminum for forming the matrix metal to be at least 0.5% and less than 4.5%, preferably at least 0.7% and less than 4.5%, and more preferably at least 1.0% and less than 4.0%.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

TABLE 1

| ALLOY NUMBER | percentage (remainder aluminum) of Mg | Si | Cu | Fe | Mn | Cr | Zn | Ti | Melting point °C. | Remarks |
|---|---|---|---|---|---|---|---|---|---|---|
| 1 | 0.1 | 0.2 | 0.1 | 0.15 | 0.05 | 0.05 | 0.1 | 0.05 | 660 | pure |
| 2 | 0.7 | 0.3 | 0.1 | 0.1 | 0.05 | 0.05 | 0.3 | 0.07 | 655 | aluminum |
| 3 | 1.9 | 0.3 | 0.1 | 0.15 | 0.1 | 0.03 | 0.2 | 0.1 | 650 | |
| 4 | 3.6 | 0.2 | 0.2 | 0.1 | 0.1 | 0.02 | 0.2 | 0.15 | 643 | Al—Mg type |
| 5 | 4.8 | 0.4 | 0.05 | 0.2 | 0.2 | 0.05 | 0.1 | 0.1 | 635 | |
| 6 | 6.8 | 0.3 | 0.1 | 0.1 | 0.1 | 0.06 | 0.1 | 0.1 | 625 | |
| 7 | 9.8 | 0.3 | 0.1 | 0.15 | 0.3 | 0.05 | 0.3 | 0.05 | 607 | |
| 8 | 0.1 | 1.1 | 0.1 | 0.3 | 0.2 | 0.03 | 0.4 | 0.15 | 655 | |
| 9 | 0.2 | 1.9 | 0.05 | 0.2 | 0.4 | 0.03 | 0.5 | 0.12 | 650 | |
| 10 | 0.1 | 4.0 | 0.1 | 0.2 | 0.2 | 0.02 | 0.4 | 0.15 | 635 | Al—Si type |
| 11 | 0.1 | 7.6 | 0.1 | 0.4 | 0.3 | 0.01 | 0.1 | 0.18 | 600 | |
| 12 | 0.2 | 18.0 | 0.05 | 0.1 | 0.5 | 0.01 | 0.1 | 0.15 | 600 | |
| 13 | 0.1 | 0.4 | 1.1 | 0.2 | 0.2 | 0.02 | 0.2 | 0.2 | 657 | |
| 14 | 0.05 | 0.5 | 2.0 | 0.2 | 0.3 | 0.03 | 0.3 | 0.15 | 655 | Al—Cu type |
| 15 | 0.1 | 0.2 | 3.9 | 0.3 | 0.3 | 0.02 | 0.3 | 0.1 | 650 | |
| 16 | 0.1 | 0.2 | 7.8 | 0.5 | 0.4 | 0.05 | 0.2 | 0.1 | 640 | |

TABLE 2

| TEST SAMPLE NO. | 0° fiber orientation bending strength (kg/mm$^2$) TEST RESULTS | | | | | | AVG. | 90° fiber orientation bending strength (kg/mm$^2$) TEST RESULTS | | | | AVG. | bending fatigue strength for $10^7$ repetitions (kg/mm$^2$) |
|---|---|---|---|---|---|---|---|---|---|---|---|---|---|
| 1 | 74 | 79 | 82 | 83 | 84 | — | 80.4 | 18 | 21 | 22 | 25 | 21.5 | 39.5 |
| 2 | 78 | 80 | 81 | 84 | 85 | — | 81.6 | 30 | 32 | 35 | 38 | 33.8 | — |
| 3 | 78 | 79 | 85 | 87 | 91 | 94 | 85.7 | 38 | 40 | 45 | 45 | 42.0 | — |
| 4 | 80 | 81 | 84 | 85 | 88 | 97 | 85.8 | 51 | 55 | 57 | 47 | 52.5 | 47.0 |
| 5 | 79 | 80 | 82 | 83 | 86 | — | 82.0 | 48 | 49 | 53 | 55 | 51.3 | — |
| 6 | 73 | 75 | 77 | 78 | 78 | — | 76.2 | 45 | 47 | 48 | 52 | 48.0 | — |
| 7 | 66 | 68 | 71 | 70 | 73 | — | 69.6 | 40 | 42 | 44 | 44 | 42.5 | — |
| 8 | 68 | 73 | 81 | 84 | — | — | 76.5 | — | — | — | — | — | — |
| 9 | 72 | 74 | 75 | 75 | 81 | — | 75.4 | — | — | — | — | — | — |
| 10 | 73 | 74 | 74 | 77 | — | — | 74.5 | — | — | — | — | — | — |
| 11 | 71 | 72 | 73 | 75 | 78 | — | 73.8 | 41 | 35 | 43 | 43 | 40.5 | 36.5 |
| 12 | 50 | 52 | 53 | 54 | — | — | 52.3 | — | — | — | — | — | — |
| 13 | 76 | 77 | 80 | 82 | 83 | — | 79.6 | — | — | — | — | — | — |
| 14 | 70 | 71 | 74 | 76 | 80 | — | 74.2 | — | — | — | — | — | — |
| 15 | 68 | 68 | 72 | 75 | 76 | — | 71.8 | 38 | 42 | 43 | 44 | 41.8 | 35.0 |

TABLE 2-continued

| TEST SAMPLE NO. | 0° fiber orientation bending strength (kg/mm²) TEST RESULTS | | | | | AVG. | 90° fiber orientation bending strength (kg/mm²) TEST RESULTS | | | | AVG. | bending fatigue strength for $10^7$ repetitions (kg/mm²) |
|---|---|---|---|---|---|---|---|---|---|---|---|---|
| 16 | 63 | 65 | 66 | 66 | 69 | — 65.8 | — | — | — | — | — | — |

TABLE 3

| TEST SAMPLE NO. | 0° fiber orientation bending strength (kg/mm²) TEST RESULTS | | | | | AVERAGE |
|---|---|---|---|---|---|---|
| 1 | 137 | 137 | 114 | 129 | — | 129.3 |
| 2 | 121 | 152 | 133 | 135 | — | 135.3 |
| 3 | 145 | 140 | 166 | 154 | 143 | 149.6 |
| 4 | 132 | 130 | 131 | 144 | 159 | 139.2 |
| 5 | 130 | 135 | 137 | 125 | 127 | 130.8 |
| 6 | 120 | 126 | 127 | 117 | 129 | 123.8 |
| 7 | 137 | 114 | 122 | 119 | — | 123.0 |
| 8 | 128 | 125 | 106 | 115 | — | 118.5 |
| 9 | 106 | 110 | 115 | 121 | — | 113.0 |
| 10 | 106 | 108 | 108 | 119 | — | 110.3 |
| 11 | 105 | 108 | 109 | 121 | — | 110.8 |
| 12 | 101 | 99 | 105 | 112 | — | 104.3 |
| 13 | 120 | 125 | 128 | 130 | 114 | 123.4 |
| 14 | 130 | 114 | 125 | 118 | — | 121.8 |
| 15 | 109 | 115 | 120 | 105 | — | 112.3 |
| 16 | 95 | 98 | 110 | 86 | 115 | 100.8 |

What is claimed is:

1. A fiber reinforced metal type composite material, composed essentially of a mass of reinforcing fibers selected from the group consisting of alumina fibers, carbon fibers, and mixtures thereof, intimately compounded with a matrix metal which is an alloy consisting essentially of between about 0.5% and about 4.5% magnesium, less than about 0.2% each of copper and titanium, less than about 0.5% each of silicon, zinc, iron, and manganese, and remainder aluminum.

2. A fiber reinforced metal type composite material according to claim 1, wherein the amount of magnesium in said matrix metal alloy is between about 0.7% and about 4.5%.

3. A fiber reinforced metal type composite material according to claim 2, wherein the amount of magnesium in said matrix metal alloy is between about 1.0% and about 4.0%.

4. A fiber reinforced metal type composite material according to any one of claims 1 through 3, wherein said reinforcing fibers are alumina fibers.

5. A fiber reinforced metal type composite material according to any one of claims 1 through 3, wherein said reinforcing fibers are carbon fibers.

6. A fiber reinforced metal type composite material according to any one of claims 1 through 3, wherein said reinforcing fibers are an approximately fifty/fifty by volume mixture of alumina fibers and carbon fibers.

* * * * *